US005332088A

United States Patent [19]

Schreiber

[11] Patent Number: 5,332,088

[45] Date of Patent: Jul. 26, 1994

[54] FRUIT DISPLAY BOX WITH HAND HOLES

[76] Inventor: Harry A. Schreiber, 105 Doubloon Dr., Slidell, La. 70461

[21] Appl. No.: 810,145

[22] Filed: Dec. 19, 1991

[51] Int. Cl.[5] ..... B65D 5/46

[52] U.S. Cl. ..... 206/44 R; 229/23 BT; 229/117.16; 426/110

[58] Field of Search ..... 206/44 R; 229/117.13, 229/117.16, 23 BT, 100; 426/106, 110

[56] References Cited

U.S. PATENT DOCUMENTS

| | | | |
|---|---|---|---|
| 2,340,394 | 2/1944 | Limbert et al. | 229/117.17 |
| 2,615,613 | 10/1952 | Reeser | 229/117.17 |
| 3,005,717 | 10/1961 | Pilbos | 426/106 |
| 4,101,052 | 7/1978 | Dove | 229/117.16 |
| 4,105,152 | 8/1978 | Elward | 229/117.16 |
| 4,127,228 | 11/1978 | Hall | 229/117.16 |
| 4,184,625 | 1/1980 | Stollberg et al. | 229.16/117.16 |
| 4,325,493 | 4/1982 | Paige | 229/117.17 |
| 4,396,144 | 8/1983 | Gutierrez et al. | 229/23 BT |
| 4,811,837 | 3/1989 | Larizza | 206/44 R |

*Primary Examiner*—Jimmy G. Foster
*Attorney, Agent, or Firm*—John P. Halvonik

[57] ABSTRACT

The invention is a three piece display box of the wholesale shipping and subsequent retail display of bananas. The box comprises a base portion, a sleeve portion in connection with the base and an upper cover portion. At the packing station, the bananas are packed approximately 40 lbs to the box into the bottom base and the sleeve so that the outer whorl of bananas in the cluster is displayed through the top of the sleeve. The upper cover is placed over the package and the bananas are ready for shipping,processing and retail delivery. Upon retail delivery, the box is placed for storage with cover off and, when needed, is brought to the display shelf where the sleeve is removed and the bananas use the bottom as a base for the retail display.

4 Claims, 1 Drawing Sheet

FRUIT DISPLAY BOX WITH HAND HOLES

BACKGROUND

1. Field of the Invention

The invention relates to the field of shipment containers and in particular to a three part shipment box with bottom display base for retail display. A sleeve and cover are attached to the display bottom and are removed for retail display.

2. Prior Art

While there are shipment boxes for bananas, none that the applicant is aware of are of the three part design, nor are any used that can act as shipping and display containers.

SUMMARY OF THE INVENTION

The invention comprises a three part shipping and displaying container for clusters of bananas. The base part operates as a displaying container for the bananas once they reach a retail point. The sleeve and cover portions are attached to the display base at the packing station and remain as part of the package until they are removed at the retail point. There is a set of corresponding hand holes in the base and sleeve and another set of corresponding hand holes in the sleeve and cover.

An objective of the invention is to provide a shipping box for bananas that can act as a display container at the point of retail sale.

Another objective of the invention is to provide a shipping box for bananas that can be readily opened upon reaching the retail destination, thus reducing mishandling and damage to the bananas.

Yet another objective is to provide a shipment box with hand holes that allows the box to be readily dismantled as needed to display the banana cluster.

Other objectives of the invention will become apparent once the invention is shown and described.

DESCRIPTION OF THE PREFERRED EMBODIMENT

The package of the present invention is designed for packaging of bananas at a shipment point and then opened for display at a retail point. The three parts of the box are the bottom base (display base) the middle sleeve and upper cover. The sleeve has four side walls with an open top and bottom. The cover and the base have side walls and a bottom wall in connection with the sidewalls to thus close one end of each of those pieces.

The container may be of varied size but it is preferred that the dimensions of the fully constructed box be about 9" high, 16" wide and 20" long. A container of this size would then hold about 40 lbs of bananas, a size that is typically well suited for shipment by pallet, truck and/or ship. It is preferred that the upper cover and lower base be about half the height of the sleeve.

A set of handholes is placed in the sleeve and the base as shown. These holes in the base and sleeve and in the cover and sleeve overlie one another. The handholes in the base facilitate the movement of the container during shipment and later in the process when the display base itself is brought to the retail display. At that point, the sleeve and cover will be removed leaving the base in connection with the bananas. The handholes in the base allow for transit to the retail display point and within the confines of the store or other display area.

Figure 1:
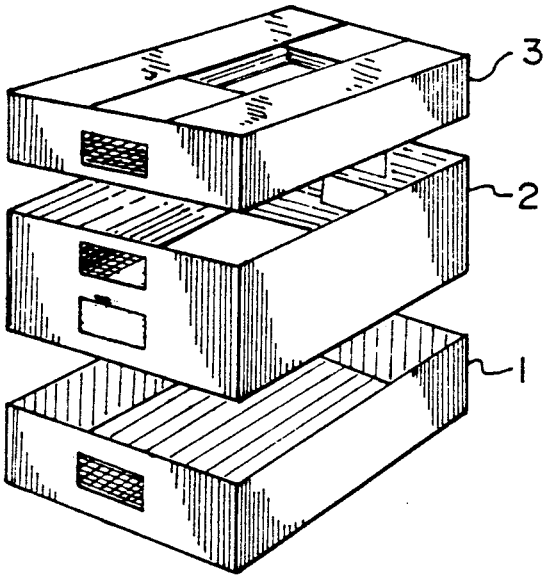
FIG. 1 shows the three part construction of the box
Figure 2:
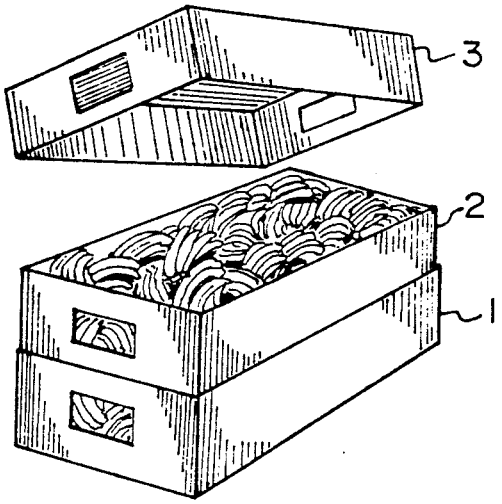
FIG. 2 shows package at the packing station
Figure 3:
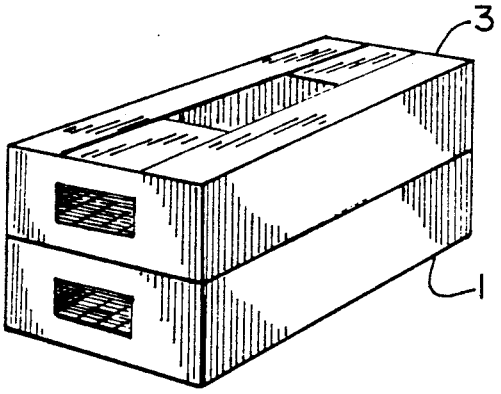
FIG. 3 shows package during shipment
Figure 4:
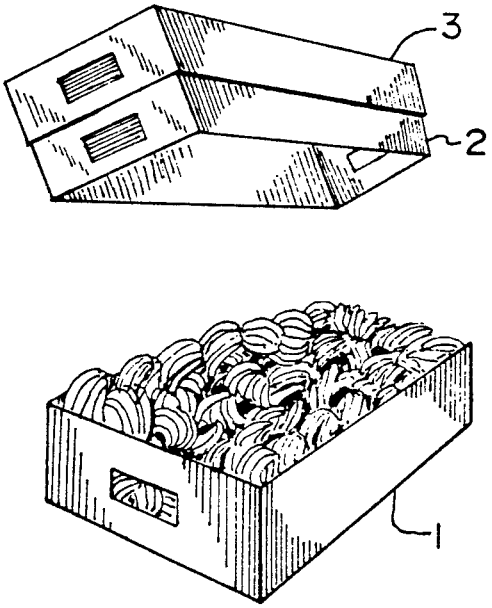
FIG. 4 shows package opened for retail display

A second set of handholes is placed in the sleeve and in the cover. Again, these holes overlie each other and they facilitate the handling of the package during shipment. IN effect, there are two sets of handholes in the sleeve, one set above the other as shown in FIG. 1. The base and cover each have one set of handholes,these overlie the two sets of handholes in the sleeve.

As the bananas are assembled for packaging, the clusters are placed in the base and sleeve combination and the cover as placed over them. The entire package is then sealed with standard packaging techniques. The box is then transported in large quantities through ship, truck, pallet, etc. Upon reaching the retail point, the cover and the sleeve are removed leaving the banana clusters on the base and ready to be displayed.

The portions also preferably have vent holes in them to aid with pulp temperature control during pulldown and ripening. These may be of the standard size and orientation of those vent holes normally used in the field.

I claim:

1. A shipping and displaying package comprising: a base member having four side walls and a bottom wall in connection with said side walls, sleeve member having four side walls, a cover member having four side walls and an upper wall in connection with the side walls flexed, said sleeve member having a first and a second pair of hand holding means, each pair of said hand holding means having a first and second hand holding means placed in a pair of said side walls of said sleeve member that are opposite one another, said base and cover members being about half the height of said sleeve member.

2. The apparatus of claim 1 wherein said cover member has a third pair of hand holding means placed in a pair of said side walls thereof that are opposite one another so that said third pair of hand holding means overlies one of said first and second pair of hand holding means.

3. The apparatus of claim 2 wherein said base member has a fourth pair of hand holding means placed in a pair of said side walls thereof that are opposite one another so that said fourth pair of hand holding means overlies one of said first and second pair of hand holding means.

4. The apparatus of claim 3 wherein said base member is about 4½" high, about 16" wide, and about 20" long, and said cover member is about 4½" high, about 16" wide and about 20" long.

* * * * *